US005123192A

United States Patent [19]

Hsieh

[11] Patent Number: 5,123,192

[45] Date of Patent: Jun. 23, 1992

[54] COLORFUL ADVERTISING DEVICE WITH REAL ARTICLE DISPLAY

[76] Inventor: Chi-Sheng Hsieh, 5F. No. 1226, Chengteh Rd., Taipei, Taiwan

[21] Appl. No.: 699,729

[22] Filed: May 14, 1991

[51] Int. Cl.[5] ..... G09F 13/00

[52] U.S. Cl. ..... 40/442; 40/560; 359/36; 359/84

[58] Field of Search ..... 40/443, 442, 541, 444, 40/560, 455, 448, 466; 340/784; 359/36, 84, 85

[56] References Cited

U.S. PATENT DOCUMENTS 3,797,914 3/1974 Aiken ..... 40/448 X 4,035,941 7/1977 Deffner ..... 40/455 X 4,739,567 4/1988 Cardin ..... 40/560 X 4,818,980 4/1989 Strosser et al. ..... 340/784

*Primary Examiner*—Kenneth J. Dorner

*Assistant Examiner*—Brian K. Green

*Attorney, Agent, or Firm*—Bacon & Thomas

[57] ABSTRACT

A show window includes a liquid crystal display plate which is alternatingly caused to become transparent in order to permit viewing of a static object displayed behind the window, and translucent in order to form a screen for projection of a slide onto the window in order to permit viewing of the slide through the window.

3 Claims, 4 Drawing Sheets

COLORFUL ADVERTISING DEVICE WITH REAL ARTICLE DISPLAY

BACKGROUND OF THE INVENTION

The present invention relates to a colorful advertising device with real article display, and more particularly to an advertising device wherein a real article display and a colorful picture and written description thereof are alternately shown by means of a microprocessor.

At present, the show window of a general commercial store often applies a music or a light effect to attract the passengers to watch the show window. However, the real article placed in the show window is static without variance so that the passenger can hardly be impressed by the article and the advertising effect is limited.

SUMMARY OF THE INVENTION

It is therefore a primary object of this invention to provide an advertising device wherein a real article display and a colorful picture and written description thereof which are shown alternately by means of a slide machine cooperating with a liquid crystal display plate.

It is a further object of this invention to provide the above device wherein a micro-processor is used to control the components of this invention to automatically alternately display the real article and colorful picture and written description thereof.

It is still a further object of this invention to provide the above device wherein a stepped motor is used to control the detecting angle of the sensor whereby in case a nearby human body is detected, an interrupting signal is transmitted to the microprocessor to immediately replace the real article display with the colorful picture and written description or replace the colorful picture and written description with the real article description.

To best understand the present invention, please refer to the following description and drawings wherein:

DETAILED DESCRIPTION OF PREFERRED EMBODIMENT

Figure 1:
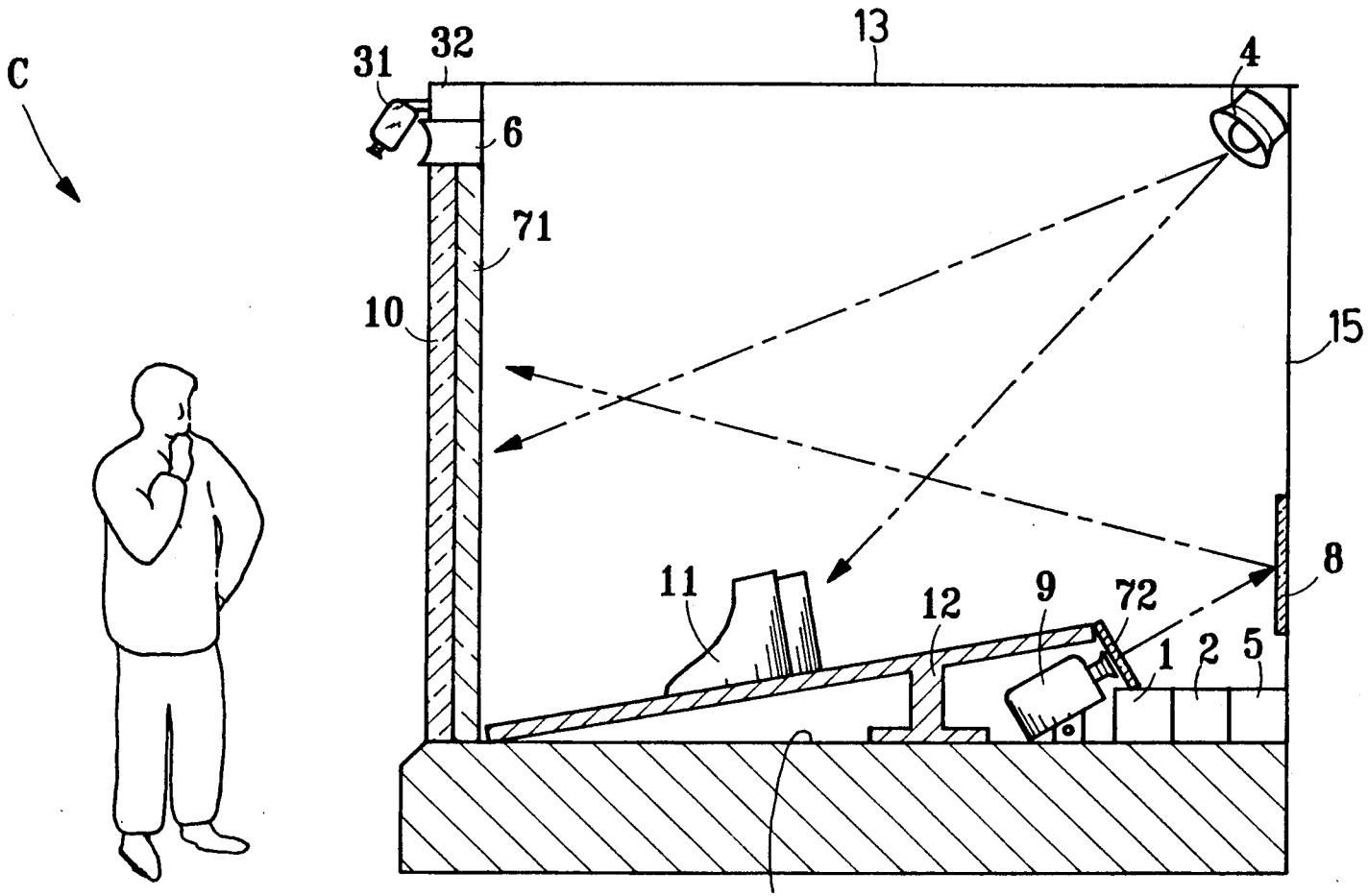
FIG. 1 shows the working of this invention.

Please refer to FIG. 1. A sensor 31 is disposed at an outer upper portion of a show window glass 10. A stepped motor 32 is disposed between the show window glass 10 and a ceiling 13 for controlling the detecting angle of the sensor 31. A speaker 6 is disposed between the stepped motor 32 and the show window glass 10 to send out the signals of an audio player 5. A liquid crystal display plate 71 is located on an inner layer of the show window glass 10. A pair of real shoes 11 are placed on a show shelf 12. A slide machine 9 is disposed between the show shelf 12 and button board 14. A liquid crystal display plate 72 covers the slide machine 9. A power supply 1 is disposed behind the slide machine 9, and a controller 2 is connected with the power supply 1 whereby the power of the power supply 1 is sent to respective components through the controller 2. The audio player 5 is placed between the controller 2 and inner wall 15. A reflecting mirror 8 is mounted on the inner wall 15 to reflect the image of the slide machine 9 onto the show window glass 10. A projecting light 4 is disposed at the corner contained by the ceiling 13 and the inner wall 15 for illuminating the shown articles.

When displaying the real articles, the power of the power supply 1 is sent to the audio player 5, projecting light 4 and the display plate 71 via the controller 2, making the display plate 71 become transparent so that a guest C can watch the shoes 11 through the glass 10 and transparent liquid crystal display plate 71. At this time, the display plate 72 is translucent to shade the slide machine 9. In addition, the audio player 5 sends out a voice to describe the shoes via the speaker 6 so that the guest C can understand the features of the article. When a preset time for the controller 2 is up or the sensor 31 senses a human body, the controller 2 on one hand interrupts the power for the audio player 5, projecting light 4 and the display plate 71, making the display plate 71 become translucent and on the other hand provides power for the slide machine 9 and display plate 72, making the display plate 72 become transparent so that the slide image can go through transparent display plate 72 to be reflected by the reflecting mirror 8 onto the translucent display plate 71. Therefore, the guest C can through the glass 10 watch a colorful picture and written description of the shown articles on the translucent display plate 71. By means of the regular time setting of the controller 2, a real article and a colorful picture and written description thereof can alternately appear in front of the guest. This can make the guest more deeply realize the features of the article.

Figure 2:
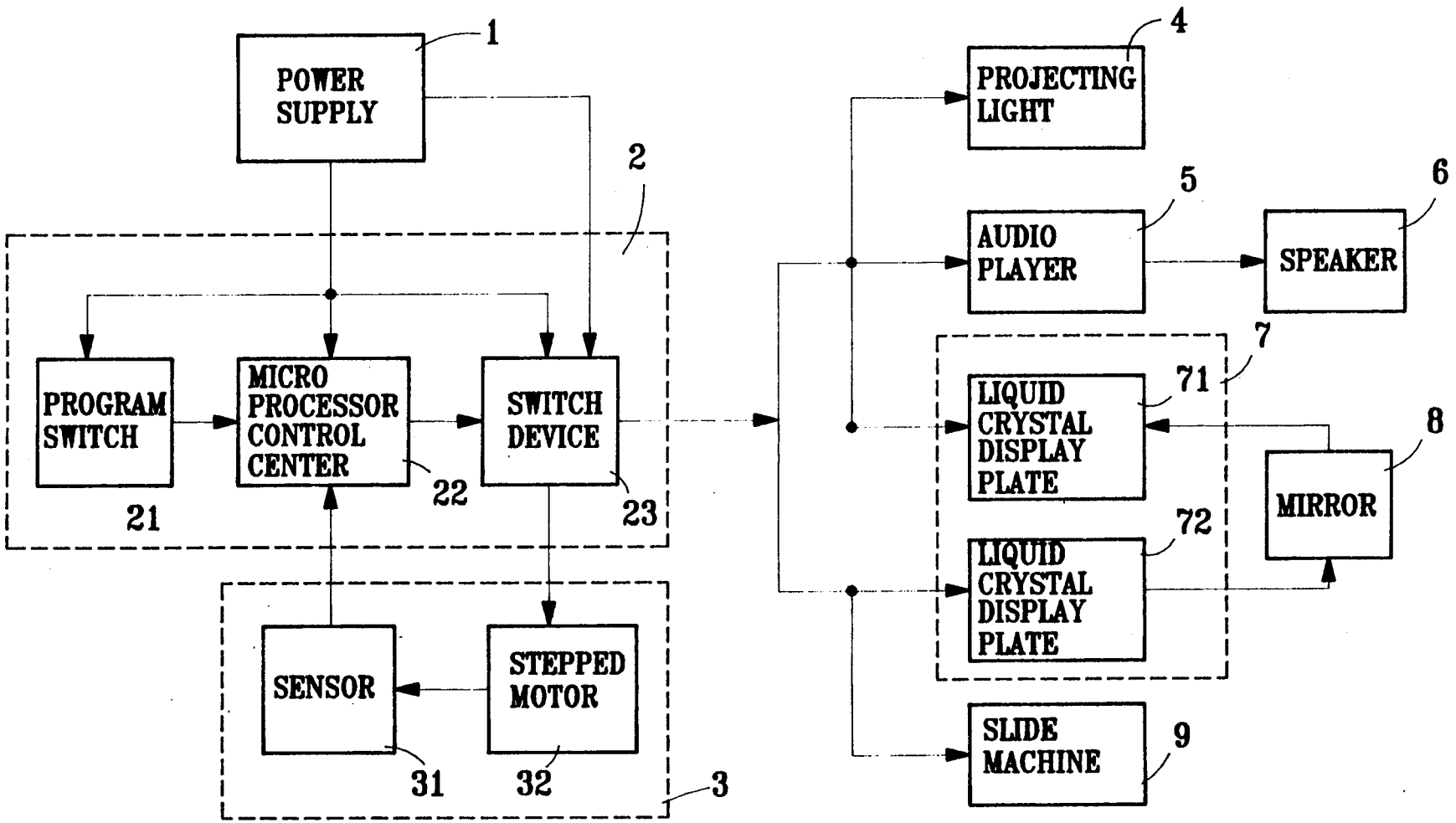
FIG. 2 is a block diagram of this invention.

Please now refer to FIG. 2, which shows a block diagram of the present invention, wherein the controller 2 is composed of a program switch 21, a microprocessor control center 22 and a switch device 23. The program switch 21 sets up the alternating time and replacing time of the slides and sends the same to the control center 22, which controls all the components of the present invention. The switch device 23 sends the power of the power supply 1 to respective components. The sensor device 3 is composed of the sensor 31 and stepper motor 32 whereby when a human body goes near, the sensor 31 transmits an interrupting signal to the control center 22, causing the real article display to be replaced by colorful picture and written description or making the colorful picture and written description be replaced by a real article display. The stepper motor 32 is set up with a rotary angle by the control center 22 to control the detecting angle of the sensor 31. The audio player 5 and speaker 6 are controlled by the control center 22 to cooperate with the real article display for describing the features of the article. The liquid crystal display plate 71 is disposed in the inner layer of the glass 10 and the liquid crystal display 72 is disposed between the slide machine 9 and the reflecting mirror 8.

By means of the time setting of the control center 22, when a real article is displayed, the control center 22 controls the switch device 2 to provide the power for the projecting light 4, audio player 5 and display plate 71, making the display plate 71 become transparent. At the same time, the display plate 72 is not provided with power so that it is translucent to shade the slide machine 9. When a colorful picture and written description needs to be shown, the control center 22 interrupts the power for the projecting light 4, audio player 5 and display plate 71 and alternatively provides power for the slide machine 9 and display plate 72 whereby the image of the slide can go through the transparent display plate 72 to be reflected by the reflecting mirror 8 onto the translucent display plate 71.

Figure 3:
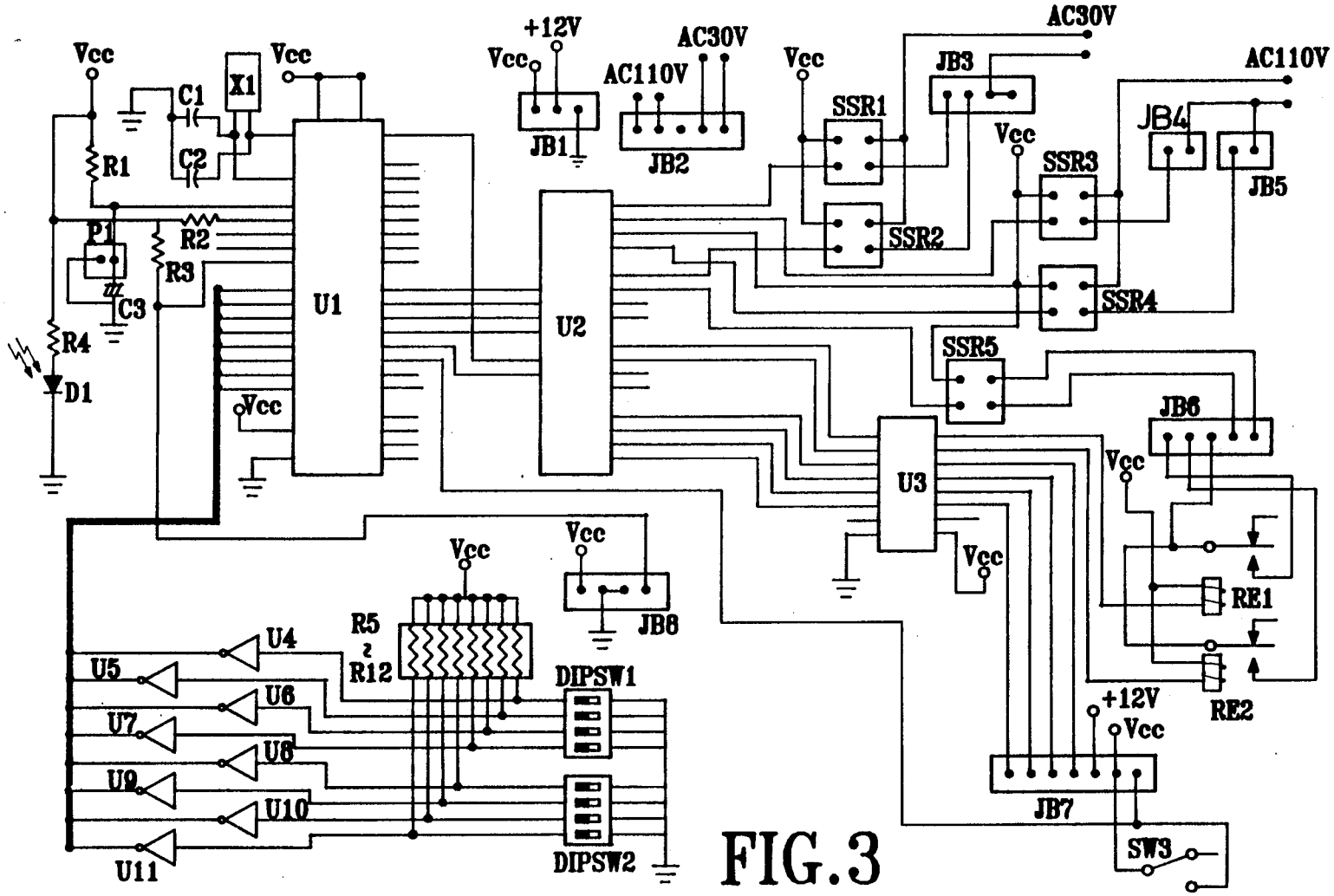
FIG. 3 is a circuit diagram of this invention.

Please refer to FIG. 3, which shows the circuit diagram of this invention. The power goes through a resistor R4 to power on a LED 01. A resistor R1 and a capacitor C3 transmit a reset signal to microprocessor U1. P1 is a button switch used to transmit a reset signal to microprocessor U1. Oscillating crystal X1 via capacitors C1, C2 inputs a timing pulse to microprocessor U1, which is a 8749 type, single chip microprocessor for controlling all the input/output. U2 is a 8243 type output/input enlarger, while SSR1, SSR2, SSR3, SSR4, SSR5 are solid relay. Relay SSR1 transmits AC30 V power from joint base JB3 to the display plate 71. Relay SSR3 transmit AC110 V power through joint base JB4 to the projecting light. Relay SSR5 transmits AC110 V power through joint base JB5 to the audio player. When altered to the slides of colorful picture and written description, the microprocessor U1 outputs a low potential control signal which goes through the enlarger U2 to relays SSR2, SSR5. Relay SSR2 transmits AC30 V power through joint base JB3 to the display plate 72. Relay SSR5 transmits AC110 V power through joint base JB6 to the slide machine.

U3 is a 2004 type drive. The control signal of the microprocessor U1 is driven by the drive U3 to go through relays RE1, RE2 to joint base JB6 to control the replacement of the slides, wherein relay RE1 controls the forward replacement of the slide while relay RE2 controls the backward replacement of the slide. Microprocessor U1 also transmits a control signal through drive U3 to JB7 for controlling the rotary angle of the stepped motor to further control the detecting angle of the sensor. In addition, when initiated, microprocessor U1 transmits a reset signal to JB7 to reset the stepped motor. The stepped motor can also be reset by a microswitch SW3.

Joint base JB8 is connected with a sensor whereby when the sensor detects a human body, it outputs an interrupting signal to microprocessor U1, causing the real article display to be replaced by the slide containing a colorful picture and written description, or causing the colorful picture and written description to be replaced by the real article display. The program switch SW1 cooperates with the resistors R9, R10, R11, R12, and reversers U4, U5, U6, U7 to set up the alternating time of the real article display and colorful picture and written description. The program switch SW2 cooperates with resistors R5, R6, R7, R7, R8 and reverses U8, U9, U10, U11 to set up the replacing time of the slides.

Figure 4:
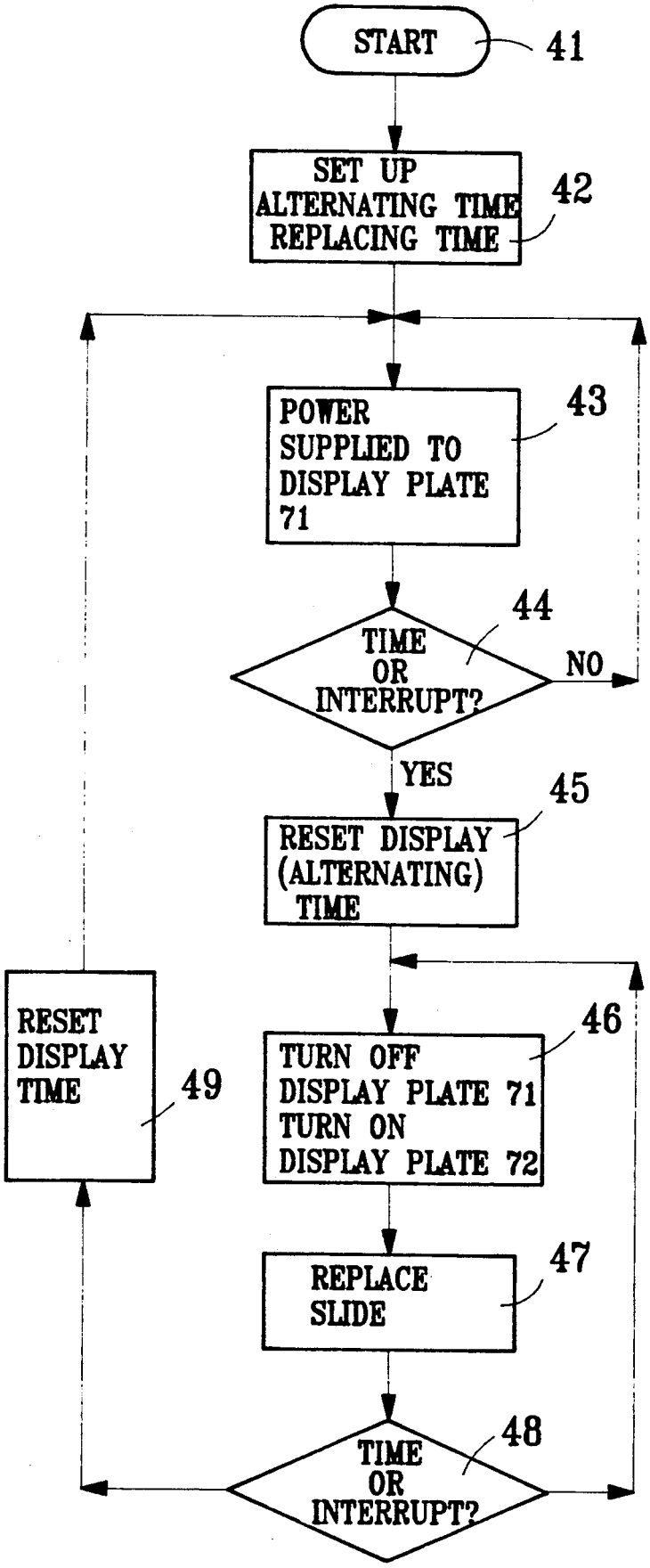
FIG. 4 is a flow chart of the operation of this invention.

FIG. 4 shows a flow chart of this invention, wherein after initiation step 41, the alternating time and slide replacing time are set up in the microprocessor (step 42). Then the power is sent to liquid crystal display plate 71, audio player and projecting light to display the real article in the show window 43. At the same time, the power for the display plate 72 is cut off so that the display plate 72 is opaque to shade the slide machine. In 44, both the status of the alternating time and the presence or absence of an interrupting signal (i.e., whether a human body has gone near) happens will be checked. In case the set up time does not expire and no interrupting signal takes place, the controller goes back to 43 and the real article display continues. In case the set up time expires or a human body is detected and an interrupting signal is produced, then in 45, the display time will be reset and it goes to 46 to cut off the power for the display plate 71, audio player and projecting light so that the real article is shaded by the opaque display plate 71. At the same time, the power is provided for the slide machine and display plate 72, making the colorful picture and written description appear on the show window glass. Then, in 47, the slides are replaced at a set up time. In 48, the set up time and interrupting signal are again checked. In case the set up time does not expire and no interrupting signal happens, then it goes back to 46 to continue the colorful picture display. In case the set up time expires or a human body is detected, then it goes to 49 to reset the display time and then it goes back to 43 to form a circular procedure.

As indicated, the structure herein may be variously embodied. Recognizing various modifications will be apparent, the scope hereof shall be deemed to be defined by the claims as set forth below.

What is claimed is:

1. A colorful advertising device including a real article display, comprising:

a show window;

a power supply;

a controller connected with said power supply and including a program switch, a microprocessor controller, and a switch device, said program switch including means for setting an alternating time and a slide replacing time, said microprocessor controller including means for controlling said switch device to transmit power from said power supply to respective components of said advertising device;

sensor means located at an outer upper portion of the show window and including a sensor and stepper motor for receiving a pulse sent from said microprocessor controller and, in response to said pulse, activating said stepper motor to rotate the sensor through a predetermined angle for controlling a detecting angle of said sensor, and means for sending an interrupting signal to said microprocessor controller when said sensor detects a passing human body;

means including a projecting light for illuminating a real article to be displayed;

a first liquid crystal display plate located on an inner layer of said show window, said first liquid crystal display plate being connected to means for causing said first liquid crystal display plate to change from a state of translucence to a state of transparency in response to switching of said switch device under control by said microprocessor controller;

slide projection means for causing a slide to be projected from a slide projector onto said first liquid crystal display plate when said liquid crystal display plate is in a translucent state; and a second liquid crystal display plate which assumes a transparent state to permit said slide to be projected onto said first liquid crystal display plate when said first liquid crystal display plate is in said translucent state;

wherein the power supplied to the first display plate is switched on or off whenever said sensor detects a human body passing near, or whenever said alternating time has elapsed, to thereby cause said display device to alternatively display said real article when said first liquid crystal display plate is in said transparent state and to display said slide when said first liquid crystal display plate is in said translucent state and said second liquid crystal display plate is in a tranparent state, and wherein a new slide is projected by said slide projector whenever said slide replacing time has elapsed.

2. An advertising device as claimed in claim 1, wherein when either of said first and second liquid crystal display plates is supplied with power and thereby turned on, liquid crystal molecules in said turned-on display plate are arranged regularly so that said turnedon display plate is transparent, while when power is cut off, the liquid crystal molecules are arranged irregularly so that said display plates are translucent.

3. An advertising device as claimed in claim 1, further comprising means including an audio player and speaker for aurally describing features of said real article.

* * * * *